United States Patent [19]

Grant

[11] Patent Number: 4,908,912

[45] Date of Patent: Mar. 20, 1990

[54] RETAINER FOR MAINTAINING A BOOK IN AN OPEN POSITION

[76] Inventor: Michael J. Grant, 2265 Avenida de Las Plantas, Thousand Oaks, Calif. 91360

[21] Appl. No.: 207,376

[22] Filed: Jun. 15, 1988

[51] Int. Cl.[4] ..... B42F 1/00

[52] U.S. Cl. ..... 24/67.11; 24/67.3; 40/658; 281/42

[58] Field of Search ..... 24/67.11, 67 R, 67.3, 24/67.9, 545, 547, DIG. 8, DIG. 9; 40/661, 658, 666; 281/42; 116/234, 236, 237, 238, 239; 248/444.1, 445, 446, 454, 459

[56] References Cited

U.S. PATENT DOCUMENTS

| | | | |
|---|---|---|---|
| 1,229,516 | 6/1917 | Pierce | 281/42 X |
| 3,701,332 | 10/1972 | Brooks | 281/42 X |
| 4,055,874 | 11/1977 | Brown | 24/67.9 X |
| 4,697,315 | 10/1987 | Geldwerth | 24/616 |

FOREIGN PATENT DOCUMENTS

| | | | |
|---|---|---|---|
| 2432880 | 1/1976 | Fed. Rep. of Germany | 24/67.9 |
| 2856049 | 6/1980 | Fed. Rep. of Germany | 24/67.3 |
| 68686 | 11/1948 | Norway | 24/67.3 |

*Primary Examiner*—Laurie K. Cranmer
*Attorney, Agent, or Firm*—Michael J. Striker

[57] ABSTRACT

A retainer for maintaining a book in an open position having a retaining element with a U-shaped portion, a clip portion, and a reinforcement portion. The clip portion extends from the U-shaped portion and the reinforcement portion strengthens the intersection of the clip portion with the U-shaped portion. A book is inserted in an open position between the U-shaped portion and the clip portion. The entire retaining element is composed of a resilient, transparent material having a single piece construction. The U-shaped portion has two legs which, together with the clip portion, make contact with the book at three locations.

4 Claims, 1 Drawing Sheet

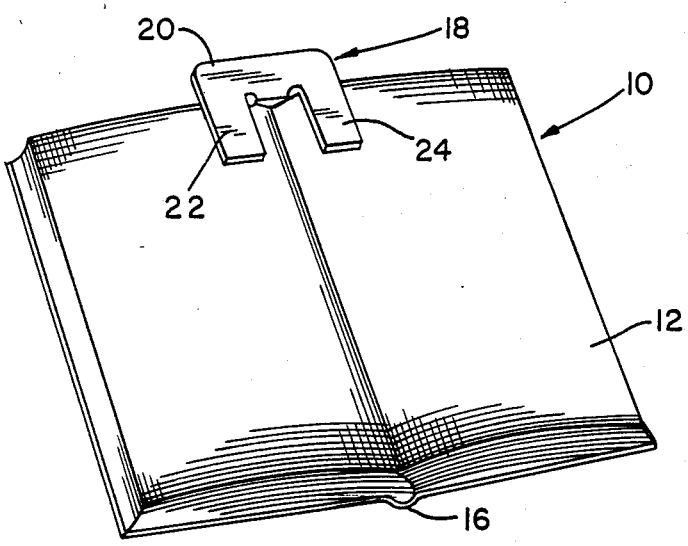
FIG. 1
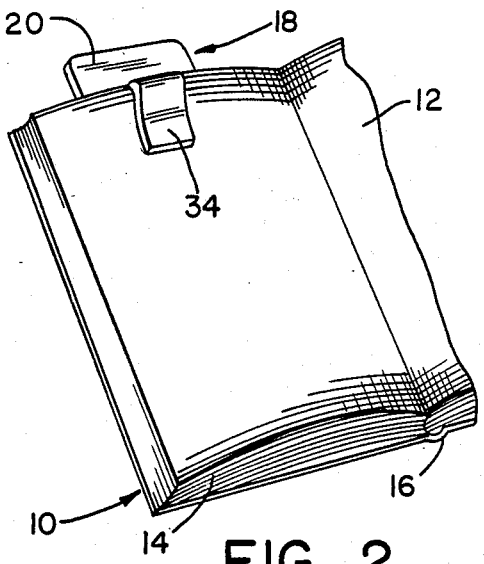
FIG. 2
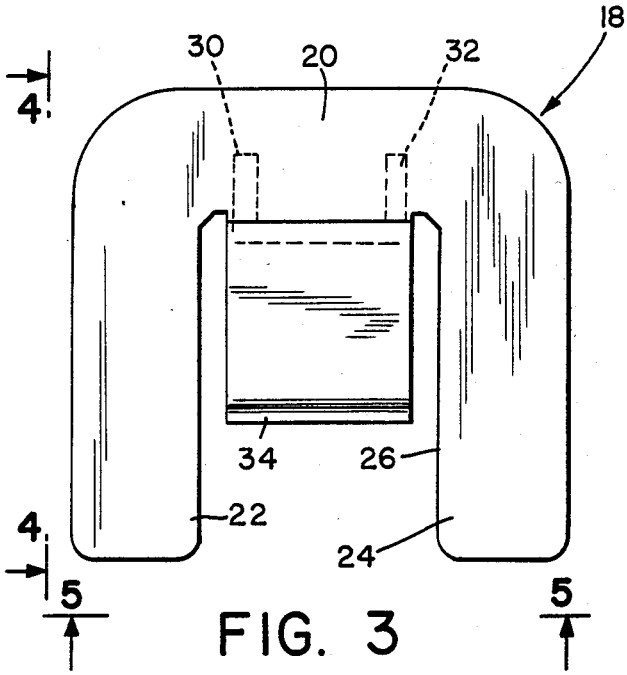
FIG. 3
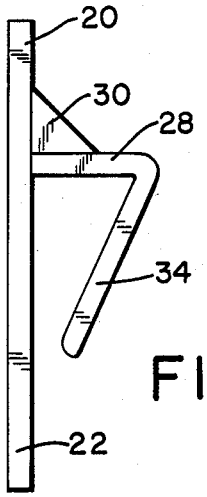
FIG. 4
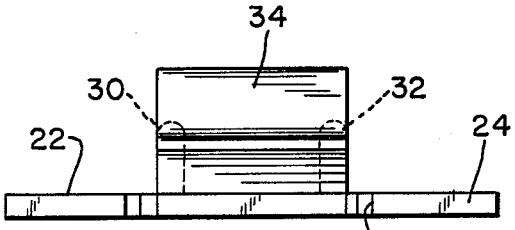
FIG. 5
FIG. 6
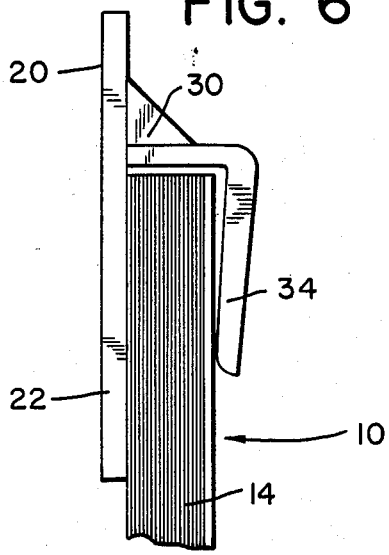

RETAINER FOR MAINTAINING A BOOK IN AN OPEN POSITION

BACKGROUND OF THE INVENTION

The present invention relates generally to a retainer that can keep a book in an open position.

When reading a book, the pages being read must be held open if the book is in an upright position.

For paperbacks and some other light books, forces in the binding cause the book to close on its own even when the book is in a horizontal position. Thus, the pages must be held open even though the book is resting on a horizontal surface.

It is inconvenient to hold both open pages with one hand at the same time. For people with arthritis, this is particularly burdensome.

SUMMARY OF THE INVENTION

It is the object of the present invention to provide a retainer for maintaining a book in an open position.

In keeping with this object, and others which will become apparent hereafter, one aspect of the invention resides, briefly stated, in a retainer for maintaining a book in an open position, having a U-shaped element, a clip element and a reinforcement element.

The U-shaped element has a planar surface forming two elongated legs extending in a common direction of elongation and a middle portion extending between the legs.

The clip element has a first portion extending from the middle portion and perpendicular to the planar surface. The clip element also has a second portion inclining toward the plane of the planar surface so as to extend along the common direction of elongation from the middle portion. The legs extend in the common direction of elongation further than does said second portion. The incline permits flexing onto the book.

The reinforcement element extends from the middle portion to the first portion so as to strengthen an intersection between the middle portion and the first portion. All of the elements together form a single piece construction and are composed of resilient material formed to releasably hold a book in an open position between the U-shaped element and the clip element. The legs are transparent to permit reading through the legs. The clip element projects from the U-shaped element so as to accomodate the book therebetween. Thus, the retainer has three points of contact holding the book in an open position: one contact at the clip element and one at each of the two legs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a front perspective view of the present invention on a book.

FIG. 2 is a rear perspective view of the present invention on a book.

FIG. 3 is a front view of the present invention.

FIG. 4 is a left side view as viewed in the direction of arrows 4—4 of FIG. 3.

FIG. 5 is a bottom side view as viewed in the direction of arrows 5—5 of FIG. 3.

FIG. 6 is a left side view as in FIG. 4, except that the present invention is shown retained on a book.

DETAILED DESCRIPTION OF THE PREFERRED EMBODIMENT

Referring now to the drawings, a retainer 18 is shown having a U-shaped element, a clip element, and a reinforcement element.

The U-shaped element has a planar surface forming two elongated legs 22, 24 and a middle portion 20 extending between the two legs 22, 24. The legs 22, 24 extend along a common direction of elongation and define an inner edge 26.

The clip element has a first portion 28 extending from the middle portion 20 perpendicular to the planar surface. The clip element also has a second portion 34 inclining inward from an end of the first portion 28 along the common direction of elongation.

The reinforcement element has two strengthening portions 30, 32 spaced apart from each other and each having a triangular cross-section. Each strengthening portion extends along an edge of the first portion 28 to the middle portion 20 so as to strengthen an area of intersection between the first portion 28 and the middle portion 20.

The entire retaining element 18 is composed of a resilient material to releasably hold an open book 10 between the U-shaped portion and the clip portion without tearing the pages 14 in the book 10. This resilient material is also transparent to permit the reading of the pages 14 through the U-shaped portion. This material is preferably durable, transparent LEXAN.

A plurality of retainers 18 can be provided, each having a different sized first portion 28 to suit different book thicknesses. In order to select the proper size retainer 18 for a desired book 10, the retainer 18 that fits the most snug onto the book 10 in a closed position is the correct retainer.

It is important that the legs 22, 24 extend in the common direction of elongation further than does the second member 34 to facilitate flexing the retainer 18 onto the book 10. The ends of the legs 22, 24 are placed onto the open pages 14 of the book 10 and then the rest of the retainer 18 is pushed on by flexing the second member 34 apart from the legs 22, 24 and inserting the book further therebetween.

The reinforcement element strengthens the intersection between the first portion 28 and the middle portion 20 to enable this intersection to withstand pressures exerted by flexing the second portion 34 relative to the legs 22, 24 and to withstand fatigue stresses due to repeated usage.

In use, the legs 22, 24 will be in contact against opposing open pages 14 as shown in FIG. 1 (or one leg is against an inside cover) and the second portion 34 will be in contact against the book cover, thereby forming three areas of contact.

When starting the book, it is adviseable to position the clip element to the right of the binder 16 of the book 10. When nearing the center of the book, the clip element is positioned on the binder 16 of the book 10. The legs 22, 24 are on separate open pages 14 of the book 10 per FIG. 1. When nearing the end of the book 10, the clip portion is positioned to the left of the binder 16 of the book 10. Since the legs 22, 24 are transparent, one can read through them without trouble.

Also, the incline of the second portion 34 is formed so that the retainer will not topple over when the outer surface of the incline rests on a flat horizontal surface.

The material of the retainer 18 is suitable for silk-screening, so that promotional advertisements can be readily imprinted onto the retainer to enhance its commercial value.

It will be understood that each of the elements described above, or two or more together, may also find a useful application in other types of retainers for maintaining a book in an open position differing from the types described above.

While the invention has been illustrated and described as embodied in a retainer for maintaining a book in an open position, it is not intended to be limited to the details shown, since various modifications and structural changes may be made without departing in any way from the spirit of the present invention.

What is claimed as new and desired to be protected by Letters Patent is set forth in the appended claims.

I claim:

1. A retainer made of resilient material for releasably holding a book having a predetermined thickness in an open position, said retainer comprising:

a U-shaped element having a planar surface forming two elongated legs extending in a common direction of elongation and defining first and second areas of contact of said retainer with the book, and a middle portion extending between said elongated legs and having outer and inner edges extending transverse to the common direction of elongation of said elongated legs;

a clip element including a first portion extending from said middle portion at said inner edge of said middle portion in a direction transverse to said planar surface of said U-shaped element, said first portion having a length measured in said transverse direction corresponding to the predetermined thickness of the book, and a second portion extending in the common direction of elongation from an end of said first portion which is opposite to an end at which said first portion is connected with said middle portion, said second portion being inclined toward said planar surface of said U-shaped element and defining a third area of contact of said retainer with the book; and a reinforcement element extending between said middle portion of said U-shaped element and said first portion of said clip element.

2. A retainer as defined in claim 1, wherein said legs extend in said common direction of elongation further than said second portion of said clip element.

3. The retainer as defined in claim 1, wherein said reinforcement element has two triangular members each having a triangular cross-section.

4. The retainer as defined in claim 1, wherein said second portion is formed with an outer surface facing away from said U-shaped portion, said second portion being formed so that the retainer remains standing and does not topple over when said outer surface rests on a flat horizontal surface.

* * * * *